US006623379B2

(12) United States Patent
Isogawa et al.

(10) Patent No.: US 6,623,379 B2
(45) Date of Patent: Sep. 23, 2003

(54) GOLF BALL

(75) Inventors: Kazuhiko Isogawa, Kobe (JP); Takashi Sasaki, Kobe (JP)

(73) Assignee: Sumitomo Rubber Industries, Limited, Kobe (JP)

( * ) Notice: Subject to any disclaimer, the term of this patent is extended or adjusted under 35 U.S.C. 154(b) by 0 days.

(21) Appl. No.: 09/907,663

(22) Filed: Jul. 19, 2001

(65) Prior Publication Data

US 2002/0032076 A1 Mar. 14, 2002

(30) Foreign Application Priority Data

Jul. 19, 2000 (JP) ..... 2000-219551

(51) Int. Cl.[7] ..... A63B 37/14; A63B 37/00

(52) U.S. Cl. ..... 473/351; 473/378; 473/365; 40/327

(58) Field of Search ..... 434/252; 473/218, 473/257, 378; 273/DIG. 30, DIG. 21; 40/327

(56) References Cited

U.S. PATENT DOCUMENTS 5,542,680 A * 8/1996 Proudfit et al. ..... 40/327
5,651,741 A * 7/1997 Masutani et al. ..... 473/200
5,785,612 A * 7/1998 Shapiro et al. ..... 40/327
5,823,890 A * 10/1998 Maruko et al. ..... 473/354
6,012,269 A * 1/2000 Vitti ..... 206/315.9
6,012,992 A * 1/2000 Yavitz ..... 273/DIG. 14
6,022,279 A * 2/2000 Yamagishi et al. ..... 473/353
6,209,452 B1 * 4/2001 Klimek ..... 101/27
6,435,984 B1 * 8/2002 Ohama ..... 473/377

FOREIGN PATENT DOCUMENTS

JP 11-114093 4/1999

* cited by examiner

*Primary Examiner*—Derris H. Banks
*Assistant Examiner*—Dmitry Suhol
(74) *Attorney, Agent, or Firm*—Birch, Stewart, Kolasch & Birch, LLP

(57) ABSTRACT

There is provided a golf ball bearing highly fashionable marks representing a brand name and a play number, both of which are excellent in visibility. The golf ball has two sorts of marks printed on its ball body surface. The two marks have similar colors and a CIE L*a*b* color difference (ΔE) between the colors of theses marks is in the range of 5 to 50.

21 Claims, 1 Drawing Sheet

COLOR DIFFERENCE (ΔE) BETWEEN THE COLOR OF THE FIRST MARK AND THE COLOR OF THE SECOND MARK : 5–50

COLOR DIFFERENCE ( Δ E) BETWEEN THE COLOR OF THE FIRST MARK AND THE COLOR OF THE SECOND MARK : 5–50

GOLF BALL

BACKGROUND OF THE INVENTION

1. Field of the Invention

The present invention relates to a golf ball bearing pastel-colored marks representing a brand name, a play number and the like printed thereon, which meets the recent demand for improved appearance and has superior mark visibility.

2. Description of the Related Art

A golf ball generally has printed marks representing a brand name, a play number and the like on a surface of their ball body. Such marks have heretofore been black-colored to contrast with white a ball body.

In recent years, however, golfers tend to prefer fashionable golf balls and, hence, it is desired that marks of a brand name and the like printed on the surface of their ball bodies be chromatic colored instead of being black or gold-colored. Among colors other than a black, pastel colors such as pink, orange, light blue and lemon are tended to be preferably employed comparing to the primary colors such as red and blue.

As an example of a mark with improved appearance, a mark having metallic luster printed with use of a metal powder-containing ink has been proposed (refer to Japanese Patent Laid-Open Gazette No. HEI 11-114093). Addition of metal powder to an ink, however, causes the adherence of the ink to a golf ball body surface to lower, thus resulting in a problematic mark easy to peel off.

Golf balls generally bear parallel-printed marks including a brand name mark and a play number mark for distinction of each ball.

The play number is a numeral or the like which is printed on a ball body separately from a brand name in order to identify the ball thereby allowing golfers playing together to distinguish their respective balls from each other even if the balls used by them are of the same sort. A commercially-available one-dozen golf ball carton, for example, contains four groups of golf balls bearing four printed play numbers 1, 3, 5 and 7, respectively, each group consisting of three balls. If there are plural golfers using golf balls of the same brand name and of the same type among golfers playing together, use of balls with different play numbers by such golfers allows the golfers to distinguish their own balls from each other.

In view of such a role of a play number, the play number is usually colored different from a brand name printed at a location close to the play number so that the play number can be easily distinguished from the brand name. For instance, the brand name is printed with a blue ink, while the play number printed with a red ink, whereby both the marks are made highly visible.

However, a combination of opposite primary colors such as a combination of red and blue, together with the strength of such primary colors, imparts a sensation of garishness to the golfer and hence is not preferred by recent golfers having a preference for improved appearance of golf balls.

In the case where the marks are formed using pastel color inks having good visibility to satisfy the demand for improved appearance, the lightness of such pastel colors in combination with the whiteness of the ball body may make the marks themselves less visible or may make distinction between the brand name and the play number difficult.

SUMMARY OF THE INVENTION

The present invention relates to a highly fashionable golf ball bearing a brand name mark and a play number mark, and satisfying a demand for an improved appearance without impairing superior visibility of these marks.

A golf ball of the present invention comprises a ball body, and a first mark and a second mark printed on the ball body, wherein the first mark and the second mark have similar colors and a CIE L*a*b* color difference (ΔE) between the color of the first mark and the color of the second mark is in the range of 5 to 50.

The foregoing and other objects, features and attendant advantages of the present invention will become apparent from the reading of the following detailed description in conjunction with the attached drawing.

DETAILED DESCRIPTION OF THE PREFERRED EMBODIMENTS

Figure 1:
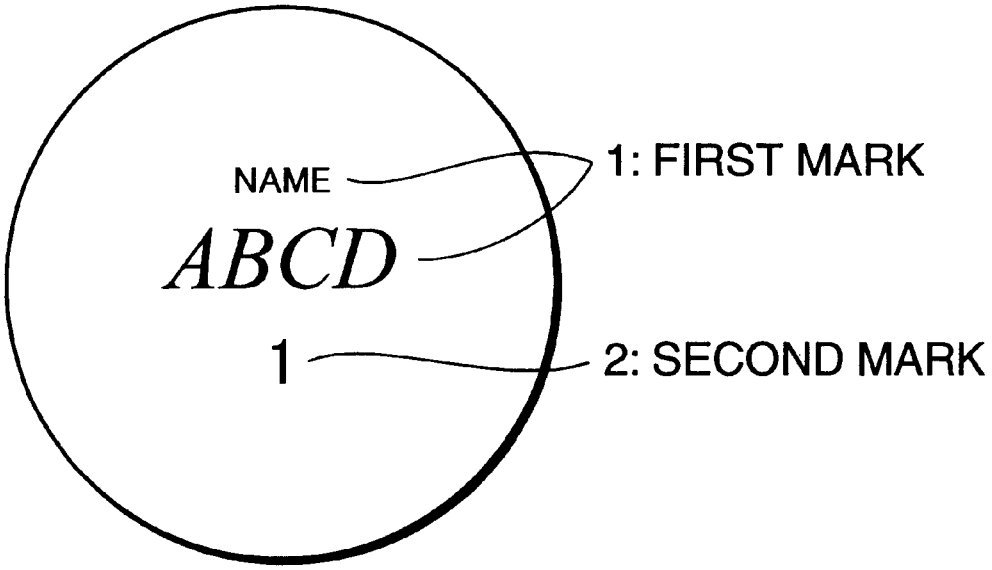
FIG. 1 is a schematic view showing the appearance of a golf ball according to the present invention. Marks 1 and 2 are printed on a ball body surface.

The golf ball according to the present invention bears two sorts of marks required to be distinguished from each other on a surface of the ball body. The ordinal combination of such marks is a combination of a brand name and a play number. The present invention is applicable to a combination of a brand name and an owner's name or a like combination. The two sorts of marks (hereinafter referred to as "first mark" and "second mark") are color-printed so as to satisfy the following conditions: the first mark and the second mark have similar colors and a CIE L*a*b* color difference (ΔE) between the color of the first mark and the second mark is in the range of 5 to 50.

The CIE L*a*b* color system is prescribed by JIS Z8729, wherein "L*" represents lightness (what is called "whiteness"), and "a*" and "b*" each represent a chromaticity (what is called a "shade") indicative of a hue and a chroma. The values of "L*", "a*" and "b*" can be found from the following formulae using tristimulus lines X, Y and Z prescribed by JIS Z8701 or JIS Z8782.

$$L=116\times(Y/Yn)^{1/3}-16$$

$$a=500\times[(X/Xn)^{1/3}-(Y/Yn)^{1/3}]$$

$$b=200\times[(Y/Yn)^{1/3}-(Z/Zn)^{1/3}]$$

In the above formulae, Xn, Yn and Zn are tristimulus values in the XYZ standard colorimetric system of a perfect diffuse reflection surface, and Y/Yn, X/Xn and Z/Zn are each larger than 0.008856.

In the present invention, "L*") "a*" and "b*" of CIE L*a*b* color system are measured with respect to the marks in a state printed on a ball body surface. In the case where the ball body and marks printed thereon are covered with a clear film, these values are measured with respect to the marks covered with the clear film.

The aforementioned conditions will be described in detail.

Firstly, the first mark and the second mark have similar colors. Even though the two adjacent printed marks, namely the first mark and the second mark, have similar colors, they can ensure necessary visibility and are distinguishable from each other if they satisfy other conditions required by the present invention. On the other hand, if these two adjacent printed marks are colored with opposite colors, they would impart a sensation of garishness, which is not preferred by recent golfers.

The term "similar color" is used to represent the following relation between the color of the first mark and the color of the second mark: a root of the sum of the square of the difference ($\Delta a^2$) in the a* of CIE L*a*b* color system between the color of the first mark and the color of the second mark and the square of the difference ($\Delta b^2$) in the b* of CIE L*a*b* color system between the color of the first mark and the color of the second mark, namely $(\Delta a^2+\Delta b^2)^{1/2}$, is not less than 1 and not more than 35, preferably not less than 5 and not more than 30, more preferably not less than 10 and not more than 25. If the value of $(\Delta a^2+\Delta b^2)^{1/2}$ is less than 1, the colors of the two marks become substantially identical with each other and, hence, distinction between the two marks becomes difficult and, besides, such substantially identical colors in combination with the whiteness of the ball present a monotonous image, thus making the ball less fashionable. If the value of $(\Delta a^2+\Delta b^2)^{1/2}$ is more than 35, the combination of the colors becomes close to a combination of opposite colors and, hence, some color selections for the two marks may impart a sensation of garishness, which is far from the recent preference for light colors.

Secondly, the CIE L*a*b* color difference (ΔE) between the color of the first mark and the color of the second mark is in the range of 5 to 50. The term "color difference (ΔE)" herein used means a color difference synthetically determined from values of L*, a* and b*. Specifically, the color difference ΔE is calculated from the following formula:

$$\Delta E=[(\Delta L)^2+(\Delta a)^2+(\Delta b)^2]^{1/2}$$

where ΔL, Δa and Δb are differences in L*, a* and b* of CIE L*a*b* color system respectively between the color of the first mark and the color of the second mark.

A very small ΔE indicates that the L*, a* and b* of the color of one mark are substantially equal to those of the color of the other mark and, hence, the colors of the two marks are substantially identical with each other. On the other hand, a very large ΔE value indicates that the difference in L* is too large and, hence, one of the marks is in a dark gray to black color, or that the difference in a* or b* is large and, hence, the combination of the colors of the two marks is a combination of opposite colors. Accordingly, the combination of the marks in respective colors having a very large ΔE does not provide a favorable impression even though such a large ΔE reflects the case where any one of the ΔL, Δa and Δb values is large. In order to make a favorable impression, the ΔE value assumes not less than 5 and not more than 50, preferably not less than 10 and not more than 45, more preferably not more than 30. If the color difference ΔE is less than 5, the two marks appear to have substantially the same color, with the result that it is difficult to distinguish the two marks from each other and, besides, the combination of the two marks presents a monotonous image, which fails to improve appearance of the golf ball. If the color difference ΔE is more than 50, the combination of the two marks does not make a favorable impression even though such a large color difference reflects the case where any one of the ΔL, Δa and Δb values is large.

Preferably, the a* and b* of CIE L*a*b* color system of the color of each of the first and second marks satisfy the following formula:

$$20\leqq(a^{*2}+b^{*2})^{1/2}$$

The a* and b* indicate color directions. Specifically, +a* indicates the direction toward red, while −a* indicates the direction toward green. +b* indicates the direction toward yellow, while −b* indicates the direction toward blue. As the absolute value of a* or b* increases, the respective hues become stronger. The value of $(a^{*2}+b^{*2})^{1/2}$ indicates a chroma. A color having a larger value of $(a^{*2}+b^{*2})^{1/2}$ means a more vivid color, while a color having a smaller value of $(a^{*2}+b^{*2})^{1/2}$ means a darker color. If the value of $(a^{*2}+b^{*2})^{1/2}$ is less than 20, the chroma of the color of each mark is lessened too much and, hence, the color of the mark is within the range of black to white, failing to improve the appearance of the golf ball. Further, if a mark in a gray to white color is printed on a white ball body, such a mark is less visible. Alternatively, if a mark is in a dark gray to black color, such a mark makes a monotonous and unfavorable impression. By adjusting the chroma of the color of each mark to 20 or more, preferably 25 or more, more preferably 30 or more, the color of the mark becomes a reddish, yellowish, bluish or greenish vivid color satisfying the requirement for improving the appearance of the golf ball.

The L* of the color of each of the first and second marks is preferably not less than 35, more preferably not less than 40, further more preferably not less than 45. The upper limit of the L* is preferably 90, more preferably 85, further more preferably 80. The L* is indicative of the lightness. A larger L* indicates a brighter and lighter color, namely, a pastel color obtained by mixing a white color with a chromatic color. With the L* within the above range, the color of each of the first and second marks becomes pink, orange, lemon yellow, light blue or light green depending upon the a* and b* thereof. If the L* is less than 35, the color of each mark becomes a blackish dark color, for example, crimson, dark carmine, brick-color or cocoa, which does not make a favorable impression. If the L* is more than 90, the color of each mark becomes too whitened and, hence, the mark is hard to perceive and has lower visibility.

The difference (ΔL) in the L* between the color of the first mark and the color of the second mark is preferably not less than 1, more preferably not less than 3, furthermore preferably not less than 5. If the ΔL is less than 1, both of the colors of the two marks become too bright or too dark and hence make a monotonous impression. Further, colors having certain a* and b* values and ΔL of less than 1 make it difficult to distinguish the two marks from each other. On the other hand, if the ΔL is too large, the difference between the brightness and the darkness becomes too large and, hence, the mark in a lighter color is likely to become less visible. For this reason, the ΔL is preferably not more than 40, more preferably not more than 35, furthermore preferably not more than 30.

In order for the ΔL to fall within the foregoing range, it is required that one of the first and second marks be colored stronger. In the case of a combination of a brand name and a play number, it is preferred that the brand name be colored stronger because the brand name has a higher degree of designing and, hence, coloring of the brand name with a stronger color makes the combination of the marks more fashionable.

The color of the ball body surface is preferably white because the marks in chromatic colors contrast with a white ball body particularly effectively and hence are readily perceptible.

For the formation of marks satisfying the foregoing conditions, the kind and the amount of each coloring pigment to be contained in an ink are selected so as to meet the foregoing requirements.

Examples of usable inorganic coloring agents include red pigments such as red oxide ($Fe_2O_3$), minium ($Pb_3O_4$), molybdenum red, and cadmium red; yellow pigments such as titanium yellow ($20TiO_2$—NiO—$Sb_2O_3$), litharge (PbO), chrome yellow ($PbCrO_4$), yellow oxide (FeO(OH)), and cadmium yellow; blue pigments such as cobalt blue ($CoO.Al_2O_3$), Prussian blue, and ultramarine blue; orange pigments such as chrome orange, molybdenum orange, and permanent orange GTR; violet pigments such as manganese violet; green pigments such as chrome green and chrome oxide; and white pigments such as zinc white, titanium oxide, antimony white, zinc sulfide, baryte powder, barium carbonate, clay, silica, white carbon, talc, and alumina white.

Examples of usable organic coloring agents include azo pigments or azo dyes, phthalocyanine pigments, perylene pigments, indanthrene dyes, and dioxane dyes. Examples of specific azo pigments or azo dyes include monoazo compounds, bisazo compounds, trisazo compounds, and azoic dyes.

Any ink that can develop any desired one of the foregoing colors can be used in the present invention. In addition to the foregoing coloring agents, a thermoplastic resin is used as a vehicle in such an ink. Examples of such thermoplastic resins include vinyl resins such as a vinyl chloride-vinyl acetate-vinyl alcohol terpolymer, urethane resins, epoxy resins, polyester resins, acrylic resins, and polyethyleneimine resins. As required, the ink may contain a plasticizer, a filler and the like in addition to the foregoing components.

The marks according to the present invention may be printed by any printing method without any particular limitation. Examples of printing methods include a method employing a transfer foil and a method using a pad.

According to the present invention, any type of golf ball body, for example, one-piece golf ball bodies, multi-piece golf ball bodies and wound-core golf ball bodies may be used.

A preferable golf ball further comprises a clear film covering the ball body and the first mark and the second mark printed on the ball body. The clear film protects the marks and enhance the gloss of the entire golf ball surface. A urethane paint is preferably used for forming the clear film.

EXAMPLES

Measurement and Evaluation Methods

1. Lab Values

L*, a* and b* of the color of each mark were measured using a CIE L*a*b* color-difference colorimeter ("CR-221" manufactured by MINOLTA CO.).

2. CIE L*a*b* Color Difference (ΔE)

The color difference (ΔE) between the color of a first mark and the color of a second mark was determined according to JIS Z8729. The L*, a*, and b* of each of a first mark (brand name) and a second mark (play number) were measured with the CIE L*a*b* color-difference colorimeter ("CR-221" manufactured by MINOLTA CO.) to determine the differences (ΔL, Δa and Δb) in L*, a*, and b* of CIE color system between the colors of the two marks in L*, a*, and b*, respectively, and the color difference ΔE was calculated from the following formula:

$$\Delta E=[(\Delta L)^2+(\Delta a)^2+(\Delta b)^2]^{1/2}$$

3. Degree of Favorable Impression of Marks as a Whole

The degree of favorable impression of the marks printed on each golf ball was evaluated according to the following four ranking categories by ten golfers who actually took each golf ball by hand and visually observed it. A ranking category to which the largest number of golfers agreed was determined as the degree of favorable impression of a golf ball.

Ranking Categories:

Category "◎" indicates marks having beautiful color tones and looking attractive;

Category "○" indicates marks giving an ordinary impression with no sense of congruity;

Category "Δ" indicates marks imparting no sense of congruity but making not so favorable impression; and Category "X" indicates marks having an unbalanced combination of color tones and imparting a sense of congruity.

4. Visibility of Marks

The visibility of the marks printed on each golf ball was evaluated according to the following four ranking categories by ten golfers who viewed the ball spaced 3 m from each golfer. A ranking category to which the largest number of golfers agreed was determined as the visibility of the marks.

Ranking Categories:

Category "◎" indicates marks representing a brand name and a play number which were both very perceptible;

Category "○" indicates marks representing a brand name and a play number which were both perceptible;

Category "Δ" indicates marks representing a brand name and a play number, one of which was somewhat difficult to perceive; and Category "X" indicates marks representing a brand name and a play number, one of which was difficult to perceive.

Manufacture of Golf Ball

1. Printing of Marks

On a surface of a two-piece golf ball body comprising a core and an ionomer cover covering the core were printed marks of a brand name and a play number to form a pattern as shown in FIG. 1 by the pad printing method using inks for developing colors of the shades shown in Table 1 and Table 2.

The color of each mark was obtained by adjusting the content of each of the following pigments:

Blue color: phthalocyanine pigment blue, dioxane pigment blue, and titanium oxide;

Green color: phthlocyanine pigment green, disazo pigment yellow, and titanium oxide;

Orange color: benzimidazole pigment orange, and disazo pigment yellow;

Red color: naphthol AS monoazo pigment red;

Pink color: naphthol AS monoazo pigment red, and titanium oxide; and

Black color: carbon black

2. Clear Film

After the printing of the marks, each ball body was coated with a urethane paint to form a clear film having a thickness of 10 microns.

After the coating, L*, a*, and b* of the color of each mark were measured to evaluate the degree of favorable impression and the visibility of the marks. The results are shown in Table 1 and Table 2.

TABLE 1

| No. | | 1 | 2 | 3 | 4 | 5 | 6 | 7 | 8 | 9 |
|---|---|---|---|---|---|---|---|---|---|---|
| Play number | Color | Blue | Green | Orange | Red | Blue | Blue | Blue | Pink | Blue |
| | L* | 71.30 | 76.63 | 65.74 | 44.39 | 71.30 | 49.58 | 75.82 | 62.38 | 91.42 |
| | a* | −5.66 | −35.49 | 35.87 | 60.13 | −5.66 | 4.68 | −6.97 | 43.86 | −6.59 |
| | b* | −32.29 | −3.29 | 68.17 | 28.64 | −32.29 | −51.20 | −35.47 | −6.26 | −12.64 |
| | $(a^{*2} + b^{*2})^{1/2}$ | 32.78 | 35.64 | 77.03 | 66.60 | 32.78 | 51.41 | 36.15 | 44.30 | 14.25 |
| Brand name | Color | Blue | Green | Orange | Blue | Blue | Blue | Blue | Pink | Blue |
| | L* | 49.58 | 63.19 | 57.39 | 49.58 | 32.89 | 48.86 | 29.34 | 50.64 | 71.30 |
| | a* | 4.68 | −49.41 | 50.95 | 4.68 | 7.63 | 4.71 | 8.12 | 58.72 | −5.66 |
| | b* | −50.80 | −1.29 | 61.11 | −50.80 | −16.11 | −50.79 | −13.81 | 4.16 | −32.29 |
| | $(a^{*2} + b^{*2})^{1/2}$ | 51.02 | 49.43 | 79.56 | 51.02 | 17.83 | 51.01 | 16.02 | 58.87 | 32.78 |
| Evaluation | ΔE | 30.35 | 19.45 | 18.63 | 97.02 | 43.75 | 0.83 | 53.45 | 21.62 | 28.14 |
| | ΔL | 21.72 | 13.44 | 8.35 | 5.19 | 38.41 | 0.72 | 46.48 | 11.74 | 20.12 |
| | Δa | 10.34 | 13.92 | 15.08 | 55.45 | 13.29 | 0.03 | 15.09 | 14.86 | 0.93 |
| | Δb | 18.51 | 2.00 | 7.06 | 79.44 | 16.18 | 0.41 | 21.66 | 10.42 | 19.65 |
| | $(\Delta a^2 + \Delta b^2)^{1/2}$ | 21.20 | 14.06 | 16.65 | 96.88 | 20.94 | 0.41 | 26.40 | 18.15 | 19.67 |
| | Favorable Impression | ◎ | ◎ | ◎ | X | Δ | Δ | X | ◎ | ○ |
| | Visibility | ◎ | ◎ | ◎ | ◎ | ○ | X | ◎ | ◎ | ○ |

TABLE 2

| No. | | 1 | 10 | 4 | 11 |
|---|---|---|---|---|---|
| Play number | Color | Blue | Blue | Blue | Red |
| | L* | 71.30 | 49.58 | 49.58 | 44.39 |
| | a* | −5.66 | 4.68 | 4.68 | 60.13 |
| | b* | −32.29 | −50.80 | −50.80 | 28.64 |
| | $(a^{*2} + b^{*2})^{1/2}$ | 32.78 | 51.02 | 51.02 | 66.60 |
| Brand name | Color | Blue | Blue | Red | Blue |
| | L* | 49.58 | 71.30 | 44.39 | 49.58 |
| | a* | 4.68 | −5.66 | 60.13 | 4.68 |
| | b* | −50.80 | −32.29 | 28.64 | −50.80 |
| | $(a^{*2} + b^{*2})^{1/2}$ | 51.02 | 32.78 | 66.60 | 51.02 |
| Evaluation | ΔE | 30.35 | 30.35 | 97.02 | 97.02 |
| | ΔL | 21.72 | 21.72 | 5.19 | 5.19 |
| | Δa | 10.34 | 10.34 | 55.45 | 55.45 |
| | Δb | 18.51 | 18.51 | 79.44 | 79.44 |
| | $(\Delta a^2 + \Delta b^2)^{1/2}$ | 21.20 | 21.20 | 96.88 | 96.88 |
| | Favorable Impression | ◎ | ○ | X | X |
| | Visibility | ◎ | ◎ | ◎ | ◎ |

Golf ball No. 4 had a brand name mark and a play number mark, which were colored opposite to each other (ΔE= 97.02). These marks were superior in visibility, but did not make a favorable impression although bright colors each having an "L" value of not less than 35 were used for respective marks.

Golf ball No. 7 had a brand name mark and a play number mark, which had similar colors. The visibility of each mark was satisfactory by virtue of an increased color difference (ΔE), but the marks did not make a favorable impression because they appeared to be dark due to the color of the brand name mark having too low an L* value.

Golf ball No. 6 had a brand name mark and a play number mark, which had similar colors. The two marks were difficult to distinguish from each other because the color difference (ΔE) was too small. Further, the colors of the two marks appeared to be the same at first sight and, hence, the design of the marks appeared to be monotonous and the degree of favorable impression of the marks was not so high.

Golf balls Nos. 1 to 3, 5, 8 and 9 each had marks having simolar colors with a color difference (ΔE) therebetween falling within the range of 5 to 50 and hence are examples of the present invention. Any one of these balls exhibited satisfactory mark visibility and did not impart a sense of congruity. The marks on golf ball No. 5, however, appeared to be darker due to the brand name mark having L* of slightly lower than 35 and, accordingly, the degree of favorable impression of these marks was lower than that of the marks of each of golf balls Nos. 1 to 3 and 8 colored with bright pastel colors each having L* of not less than 35. The play number mark of golf ball No. 9 was somewhat difficult to perceive because the L* of the color of this mark was higher than 90, stated otherwise, the color of the mark was significantly light. For this reason, the visibility and the degree of favorable impression of the marks of golf ball No. 9 were inferior to the marks on each of golf balls Nos. 1 to 3 and 8.

Golf balls Nos. 1 and 10 in Table 2 are examples of the present invention. Each of them had a brand name mark and a play number mark, which had similar colors with a color difference (ΔE) therebetween falling within the range of 5 to 50. The colors of the brand name mark and play number mark of each of ball No. 10 was reverse of the colors of the brand name mark and play number mark printed on ball No. 1. As can be understood from the comparison between ball No. 1 and ball No. 10, the marks including the brand name mark having a smaller L*, namely, colored heavier than the play number mark gave a higher degree of favorable impression. In the case of golf balls Nos. 4 and 11 each having a combination of opposite colors, reversal of the colors of the brand name mark and play number mark of these balls did not improve the degree of favorable impression of the marks.

The golf ball of the present invention bears marks of a brand name and the like colored with pastel colors imparting a high degree of favorable impression to the golfer. These marks can be easily distinguished from each other even if they are printed close to each other as in the case of a combination of two sorts of marks representing a brand name and a play number, which need to be distinguished from each other.

Further, a fashionable appearance of the inventive golf ball can be obtained without using metal powder-containing ink and lowering the adherence of the marks to the ball body.

This application is based on Japanese Application Ser. No. 2000-219551 filed in Japanese Patent Office on Jul. 19, 2000, the contents of which are hereby incorporated by reference.

While only certain presently preferred embodiments of the present invention have been described in detail, as will be apparent for those skilled in the art, certain changes and modifications may be made in embodiment without departing from the spirit and scope of the present invention as defined by the following claims.

What is claimed is:

1. A multi-piece golf ball comprising a ball body including a core and a cover; and first mark and a second mark printed on the ball body, wherein the first mark and the second mark have similar colors and L* of CIE L*a*b* color system of 35 to 80, respectively;

a CIE L*a*b* color difference (ΔE) between the color of the first mark and the color of the second mark is in the range of 5 to 50; and a difference (ΔL) in the L* of CIE L*a*b* color system between the color of the first mark and the color of the second mark is not less than 3.

2. A multi-piece golf ball according to claim 1, wherein a difference (Δa) in the a* of CIE L*a*b* color system between the color of the first mark and the color of the second mark and a difference (Δb) in the b* of CIE L*a*b* color system between the color of the first mark and the color of the second mark satisfy the formula:

$$1 \leqq (\Delta a^2 + \Delta b^2)^{1/2} \leqq 35.$$

3. A multi-piece golf ball according to claim 1, wherein the a* and b* of CIE L*a*b* color system of the color of each of the first and second marks satisfy the formula:

$$20 \leqq (a^{*2} + b^{*2})^{1/2}.$$

4. A multi-piece golf ball according to claim 1, wherein a difference (ΔL) in the L* of CIE L*a*b* color system between the color of the first mark and the color of the second mark is in the range of 5 to 35.

5. A multi-piece golf ball according to claim 1, wherein the color of the ball body surface is white.

6. A multi-piece golf ball according to claim 1, wherein the first mark represents a brand name and the second mark represents a play number, and the color of the second mark has a larger L* of CIE L*a*b* color system than the color of the first mark.

7. A multi-piece golf ball according to claim 1, further comprising a clear film covering the ball body and the first mark and the second mark.

8. A two-piece golf ball comprising a ball body including a core and a cover; and a first mark and a second mark printed on the ball body, wherein the first mark and the second mark have similar colors and L* of CIE L*a*b* color system of 35 to 80, respectively;

a CIE L*a*b* color difference (ΔE) between the color of the first mark and the color of the second mark is in the range of 5 to 50; and a difference (ΔL) in the L* of CIE L*a*b* color system between the color of the first mark and the color of the second mark is not less than 3.

9. A two-piece golf ball according to claim 8, wherein a difference (Δa) in the a* of CIE L*a*b* color system between the color of the first mark and the color of the second mark and a difference (Δb) in the b* of CIE L*a*b* color system between the color of the first mark and the color of the second mark satisfy the formula:

$$1 \leqq (\Delta a^2 + \Delta b^2)^{1/2} \leqq 35.$$

10. A two-piece golf ball according to claim 8, wherein the a* and b* of CIE L*a*b* color system of the color of each of the first and second marks satisfy the formula:

$$20 \leqq (a^{*2} + b^{*2})^{1/2}.$$

11. A two-piece golf ball according to claim 8, wherein a difference (ΔL) in the L* of CIE L*a*b* color system between the color of the first mark and the color of the second mark is in the range of 5 to 35.

12. A two-piece golf ball according to claim 8, wherein the color of the ball body surface is white.

13. A two-piece golf ball according to claim 8, wherein the first mark represents a brand name and the second mark represents a play number, and the color of the second mark has a larger L* of CIE L*a*b* color system than the color of the first mark.

14. A two-piece golf ball according to claim 8, further comprising a clear film covering the ball body and the first mark and the second mark.

15. A wound-golf ball comprising a ball body including a wound-core and a cover; and a first mark and a second mark printed on the ball body, wherein the first mark and the second mark have similar colors and L* of CIE L*a*b* color system of 35 to 80, respectively;

a CIE L*a*b* color difference (ΔE) between the color of the first mark and the color of the second mark is in the range of 5 to 50; and a difference (ΔL) in the L* of CIE L*a*b* color system between the color of the first mark and the color of the second mark is not less than 3.

16. A wound-golf ball according to claim 15, wherein a difference (Δa) in the a* of CIE L*a*b* color system the color of the first mark and the color of the second mark and a difference (Δb) in the b* of CIE L*a*b* color system between the color of the first mark and the color of the second mark satisfy the formula:

$$1 \leqq (\Delta a^2 + \Delta b^2)^{1/2} \leqq 35.$$

17. A wound-golf ball according to claim 15, wherein the a* and b* of CIE L*a*b* color system of the color of each of the first and second marks satisfy the formula:

$$20 \leqq (a^{*2} + b^{*2})^{1/2}.$$

18. A wound-golf ball according to claim 15, wherein a difference (ΔL) in the L* of CIE L*a*b* color system between the color of the first mark and the color of the second mark is in the range of 5 to 35.

19. A wound-golf ball according to claim 15, wherein the color of the ball body surface is white.

20. A wound-golf ball according to claim 15, wherein the first mark represents a brand name and the second mark represents a play number, and the color of the second mark has a larger L* of CIE L*a*b* color system than the color of the first mark.

21. A wound-golf ball according to claim 15, further comprising a clear film covering the ball body and the first mark and the second mark.

* * * * *